US010962270B2

(12) United States Patent
Jain et al.

(10) Patent No.: US 10,962,270 B2
(45) Date of Patent: Mar. 30, 2021

(54) TRANSPORTATION BOX

(71) Applicants: Devendra Jain, Guragon (IN); Nidhi Agarwal, Guragon (IN); Ravi Teja A. T., Guragon (IN); Deepraj Sarmah, Guragon (IN)

(72) Inventors: Devendra Jain, Guragon (IN); Nidhi Agarwal, Guragon (IN); Ravi Teja A. T., Guragon (IN); Deepraj Sarmah, Guragon (IN)

( * ) Notice: Subject to any disclaimer, the term of this patent is extended or adjusted under 35 U.S.C. 154(b) by 62 days.

(21) Appl. No.: 15/771,202

(22) PCT Filed: Oct. 21, 2016

(86) PCT No.: PCT/IB2016/056336
§ 371 (c)(1),
(2) Date: Apr. 26, 2018

(87) PCT Pub. No.: WO2017/072638
PCT Pub. Date: May 4, 2017

(65) Prior Publication Data

US 2018/0320947 A1 Nov. 8, 2018

(30) Foreign Application Priority Data

Oct. 27, 2015 (IN) ..... 3465/DEL/2015

(51) Int. Cl.
*F25D 3/08* (2006.01)
*B65D 81/38* (2006.01)
*F25D 3/06* (2006.01)

(52) U.S. Cl.
CPC ..... *F25D 3/08* (2013.01); *B65D 81/3825* (2013.01); *B65D 81/3834* (2013.01); *F25D 3/06* (2013.01);
(Continued)

(58) Field of Classification Search
CPC ..... F25D 2303/085; F25D 2303/0845; F25D 2303/0844; F25D 2303/082; F25D 2331/804
See application file for complete search history.

(56) References Cited

U.S. PATENT DOCUMENTS 5,237,838 A * 8/1993 Merritt-Munson ..... A45C 11/008 383/110
6,471,067 B1 * 10/2002 Lancaster ..... B65D 81/1275 206/523
(Continued)

*Primary Examiner* — Ana M Vazquez
(74) *Attorney, Agent, or Firm* — Au LLC; Adam E. Urbanczyk

(57) ABSTRACT

A transportation box (100) including a plurality of first phase change materials (16), a plurality of second phase change materials (20), a first box (18) adapted to enclose a payload box (10), a second box (22) and an outer box (14). The payload box (10) is embedded with the plurality of second phase change materials (20). Further, each of the plurality of first phase change materials (16) is placed above and below the payload box (10). The second box (22) is adapted to contain temperature sensitive products and is nestable within the payload box (10). The first box (18) is nestable within the outer box (14). The plurality of first phase change materials (16) and the plurality of second phase change materials (20) are arranged in a manner such that air in between controls heat flow into and within the first box (18).

21 Claims, 13 Drawing Sheets

(52) U.S. Cl.
CPC .. *F25D 2303/082* (2013.01); *F25D 2303/085* (2013.01); *F25D 2303/0844* (2013.01); *F25D 2303/0845* (2013.01); *F25D 2331/804* (2013.01); *F25D 2500/02* (2013.01)

(56) References Cited

U.S. PATENT DOCUMENTS

| | | | | |
|---|---|---|---|---|
| 6,666,032 | B1 * | 12/2003 | Rickson | A61J 1/165 62/3.6 |
| 8,074,465 | B2 * | 12/2011 | Heroux | A01N 1/0273 62/371 |
| 2002/0134962 | A1 * | 9/2002 | Romero | C09K 5/066 252/70 |
| 2011/0147391 | A1 * | 6/2011 | Corder | B65D 81/3823 220/592.27 |
| 2012/0248101 | A1 * | 10/2012 | Tumber | F25D 3/00 220/1.5 |
| 2012/0305435 | A1 * | 12/2012 | Matta | F25D 3/06 206/521 |
| 2014/0000306 | A1 * | 1/2014 | Chapman, Jr. | F25D 3/08 62/440 |
| 2014/0020878 | A1 * | 1/2014 | Miller | H05K 5/0213 165/185 |
| 2014/0166507 | A1 * | 6/2014 | Philips | B65D 5/5445 206/45.29 |
| 2014/0277302 | A1 * | 9/2014 | Weber | A61F 7/0085 607/104 |
| 2015/0191291 | A1 * | 7/2015 | Wood | B65D 81/18 220/592.1 |

* cited by examiner

TRANSPORTATION BOX

FIELD OF THE INVENTION

Embodiments of the present invention relate to thermal management systems and more particularly to a transportation box. The, transportation box maintain temperature inside the box in a desired range during transportation. Also, the transportation box is user friendly and best suited for transportation of perishable goods.

BACKGROUND OF THE INVENTION

Cascaded systems in PCM technology have been used to efficiently store and release energy at various temperatures using conventional PCMs in the past. The same can also be achieved using form stable phase change materials. Thus, multiple sheets of the form-stable phase change materials functional at different temperatures can be arranged in layers to replicate performances as in conventional cascaded systems. For successful functioning of cascade based on shape stable phase change materials, it is to be ensured that the PCM sheets which are in contact have operating (phase change) temperatures with a difference of at least 4° C. The phase change materials are suitable for storing thermal energy in form of latent heat. Different phase change temperatures provide extended controlled temperature maintenance.

Most studies used technology or highly expensive high tech cooling methods. This includes ice, frozen gel packs, vacuum panels and cooling fan.

There have been a number of solutions provided for efficient methods of transportation using PCMs and few of them have been discussed below:

U.S. Ser. No. 14/241,770 describes a method of transportation using PCMs where PCM is lined along walls of a vehicle and is charged by using cryogen like nitrogen or $CO_2$.

CN103848101A describes a transportation of medicine box incorporating vacuum panels for transportation without any specific temperature but controlled humidity.

EP1789734A1 uses dry ice as PCM which undergoes phase change during transportation and changes its phase from solid to gas.

U.S. Pat. No. 9,060,508B2 describes a method of transportation using liquid gel with many layers and desiccant is used for humidity control. The method does not describe temperature regulation method but only use of EPS layer outside a payload box.

EP2883811 exclusively uses vacuum insulated panels and aerogel as a transportation method.

WO2010132726A1 describes the use of phase change material which is to be preconditioned before use, either used in inner box or outer box.

US20100064698A1 describes the use of reflective layer over a box for extended number of back up hours.

EP2700891A2 describes the use of two types of PCMs for controlled temperature regulation of goods. Both types require pre freezing of PCM before use. This makes the system more complicated at user end. Moreover, medical goods are always in direct contact with chemical; hence presents a threat of contamination.

U.S. Pat. No. 7,257,963B2 describes uses of water and $D_2O$ as thermal storage unit for transportation where both PCMs are separated by an insulating layer and water.

The aforesaid documents and other similar solutions may strive to provide efficient methods of transportation using PCMs; however, they still have a number of limitations and shortcomings such as, but not limited to, relatively high complex structure as well as operation. Another disadvantage of these methods which include dry ice, wherein the carbon dioxide gas evolved during shipment may be dangerous to shipping personnel. This also causes a threat of explosion due to built up pressure within the box. Further, use of water in transportation in other conventional methods may result in leakage and also accounts for extra cost for shipping. In addition, conventional PCMs, when in liquid form settle down at bottom and when freezes utilize stored energy from the other PCM lead to bulging of the pouches of the PCMs at the bottom.

Accordingly, there remains a need in the prior art to have an improved transportation box, which overcomes the aforesaid problems and shortcomings.

However, there remains a need in the art for a transportation box, for transportation of temperature sensitive goods. The transportation box provides long and temperature controlled back up using phase change material (PCM) along with a novel heat transfer technique. Further, the proposed transportation box is user friendly and reliable.

OBJECT OF THE INVENTION

An object of the present invention is to provide a transportation box for transportation of perishable goods such as vaccines, enzymes, blood, body fluids and other temperature sensitive goods.

Another object of the present invention is to provide the transportation box for controlling temperature inside the box using a plurality of phase change materials (PCMs).

Another object of the present invention is to provide the transportation box which can maintain temperature inside the box between −15 to −25° C., 2 to 8° C. and 15 to 25° C. and using variants of PCMs in 5 to 10 degree range within the limits of −25 to +45° C.

Another object of the present invention is to provide the transportation box employing the plurality of PCMs which provide support to each other by passing energy from one PCM to the other and thus, provides extra number of back up hours.

Another object of the present invention is to provide the transportation box employing the plurality of PCMs, wherein one of the PCMs is charged in a freezer and other PCM temporarily stores excess cold energy to ensure that the temperature never falls below lowest temperature of the desired range.

Another object of the present invention is to utilize the PCM of defined quantity and thermal properties in such a way that the stored energy of the frozen PCM is utilized to full extent rather than conditioning of the charged PCM.

Another object of the present invention is to provide the transportation box which employs combination of PCMs, insulation and air for regulating temperature in the range of 2 to 8° C. and 15 to 25° C. for over 96 hours.

Another object of the present invention is not just to expose the PCM to a higher temperature, but to control the temperature so that the PCM will uniformly melt and freeze during the complete process.

Another object of the present invention is to provide the transportation box which employs air as a heat transfer medium inside the box.

SUMMARY OF THE INVENTION

Embodiments of the present invention aim to provide a transportation box. The transportation box provides long and temperature controlled back up using phase change materials for transporting vaccines and other temperature sensitive goods. The transportation box regulates temperature inside the box by using two or more PCMs in such a way so as to provide a controlled temperature in a desired range during transportation. The two or more PCMs provide support to each other by passing energy from one PCM to other and hence is the name cascaded system. Cascading of two or more PCMs helps providing extra number of back up hours and a fool proof technology to regulate the temperature without monitoring the degrees at each and every step. Further, the transportation box is user friendly.

In accordance with an embodiment of the present invention, the transportation box comprising a plurality of first phase change materials, a plurality of second phase change materials, a first box adapted to enclose a payload box, a second box and an outer box. The payload box is embedded with the plurality of second phase change materials along a bottom panel, a top panel and side panels of the payload box. Further, each of the plurality of first phase change materials is placed above and below the payload box. The second box is adapted to contain temperature sensitive products. The second box is nestable within the payload box and the first box is nestable within the outer box. The plurality of first phase change materials and the plurality of second phase change materials are arranged in a manner such that air in between the payload box and the plurality of first phase change materials controls heat flow into and within the first box.

In accordance with an embodiment of the present invention, the plurality of first phase change materials and the plurality of second phase change materials are filled in pouches made of material selected from, but not limited to, a group consisting of multilayer nylon and PET-Nylon. Further, the pouches of the plurality of first phase change materials are contained in a corrugated paper board box using an adhesive layer.

In accordance with an embodiment of the present invention, the payload box and the first box are made up of an insulation material selected from, but not limited to, a group consisting of polyethylene, extruded polystyrene, Expanded Polystyrene (EPS), vacuum insulated panels, XLPE, polyurethane, paperboards, honeycomb and a combination thereof.

In accordance with an embodiment of the present invention, the insulation material of the payload box is having a thickness in the range of, but not limited to, 5 mm to 100 mm.

In accordance with an embodiment of the present invention, the first box is having a thickness in the range of, but not limited to, 10 mm to 100 mm.

In accordance with an embodiment of the present invention, the payload box is made up of a material selected from, but not limited to, a group consisting of corrugated materials, HDPE, Polypropylene, paper and cloth.

In accordance with an embodiment of the present invention, the second box is made of, but not limited to, corrugated paper board.

In accordance with an embodiment of the present invention, the outer box is made of a material selected from, but not limited to, a group consisting of polystyrene foam and thick corrugated paper board.

In accordance with an embodiment of the present invention, the outer box is having a thickness in the range of, but not limited to, 1 mm to 10 mm.

In accordance with an embodiment of the present invention, the transportation box further comprising a plurality of cassettes. Each of the plurality of cassettes contains pouches of a plurality of first phase change materials and is placed above and below the payload box.

In accordance with an embodiment of the present invention, the plurality of first phase change materials are selected from, but not limited to, a group consisting of organic chemicals, inorganic chemicals, eutectic chemicals and or a combination thereof.

In accordance with an embodiment of the present invention, the plurality of second phase change materials are selected from, but not limited to, organic chemicals, eutectic chemicals, polymers, Form Stable Phase Change Materials and a combination thereof.

In accordance with an embodiment of the present invention, the plurality of first phase change materials and the plurality of second phase change materials are selected from, but not limited to, a group consisting of HS23N, HS26N, HS18N, HS15N, HS7N, HS01, OM05, FS03, OM03, FS03, OM08, HS21, OM21, FS21, HS21, HS22, FS37.

In accordance with an embodiment of the present invention, the plurality of second phase change materials are adapted to be molded into, but not limited to, pellet form, cubical form, spherical form and sheet form.

In accordance with an embodiment of the present invention, the plurality of first phase change materials are frozen before use. The plurality of second phase change materials freeze due to energy stored in the plurality of first phase change materials.

In accordance with an embodiment of the present invention, the plurality of first phase change materials, the plurality of second phase change materials and the air in between the payload box and the plurality of first phase change materials maintain a temperature in the range of −15 to −25° C. inside the transportation box.

In accordance with an embodiment of the present invention, the plurality of first phase change materials, the plurality of second phase change materials and the air in between the payload box and the plurality of first phase change materials maintain a temperature in the range of 2 to 8° C. inside the transportation box.

In accordance with an embodiment of the present invention, the plurality of first phase change materials, the plurality of second phase change materials and the air in between the payload box and the plurality of first phase change materials maintain a temperature in the range of 15 to 25° C. inside the transportation box.

In accordance with an embodiment of the present invention, the payload box comprises a plurality of lugs protruding out of the side panels, having a length in the range of, but not limited to, 5 mm to 50 mm.

In accordance with an embodiment of the present invention, the payload box is placed inside the first box at an equal distance in the range of, but not limited to, 5 mm to 50 mm from the bottom panel, the top panel and the side panels of the payload box such that each of the plurality of lugs snugly fits with sidewalls of the first box.

BRIEF DESCRIPTION OF THE ACCOMPANYING DRAWINGS

The manner, in which the above-recited features of the present invention may be understood in detail, more particular description of the invention briefly summarized above, have been referred by the embodiments, some of which are illustrated in the appended drawings. It may, however, be noted, that the drawings appended herein illustrate only typical embodiments of this invention and are therefore not to be considered limiting of its scope, for the invention may admit to other equally effective embodiments.

These and other features, benefits and advantages of the present invention will become apparent by reference to the following text figure, with like reference numbers referring to like structures across the views, wherein:

FIGS. 1(*a*) and 1(*b*) illustrate an exploded view of a transportation box in accordance with an embodiment of the present invention.

FIGS. 2(*a*) and 2(*b*) illustrate an exploded view of the transportation box in accordance with another embodiment of the present invention.

DETAILED DESCRIPTION OF THE ACCOMPANYING DRAWINGS

Figure 1A:
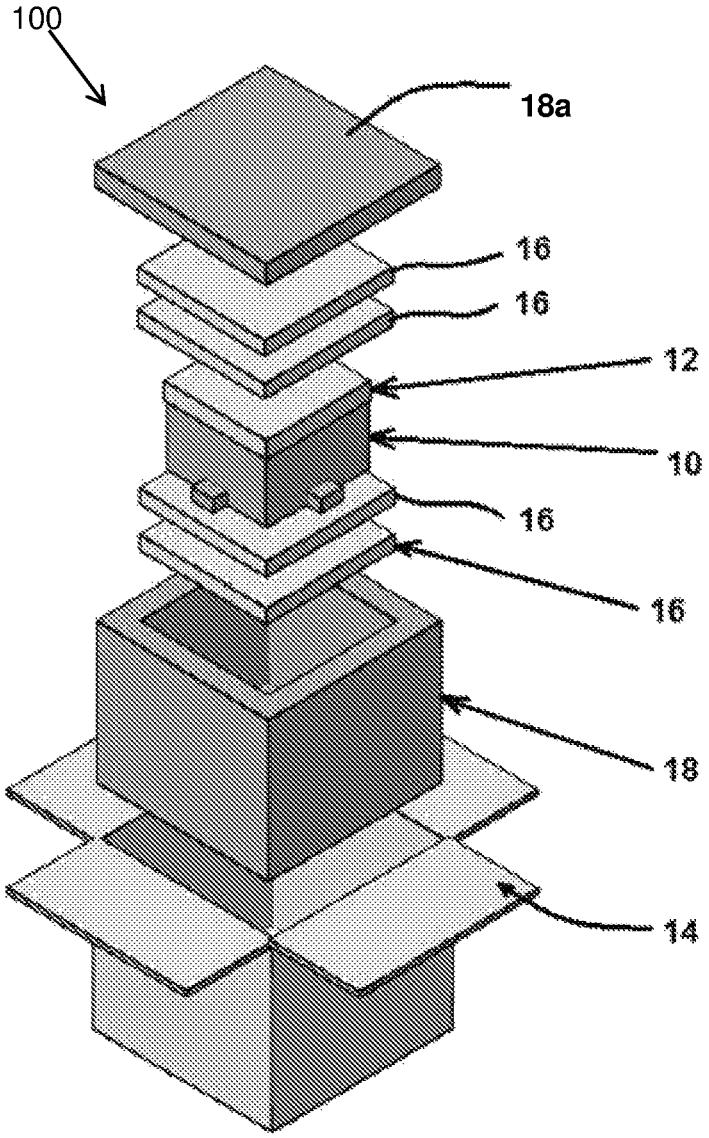

While the present invention is described herein by way of example using embodiments and illustrative drawings, those skilled in the art will recognize that the invention is not limited to the embodiments of drawing or drawings described, and are not intended to represent the scale of the various components. Further, some components that may form a part of the invention may not be illustrated in certain figures for ease of illustration, and such omissions do not limit the embodiments outlined in any way. It should be understood that the drawings and detailed description thereto are not intended to limit the invention to the particular form disclosed, but on the contrary, the invention is to cover all modifications, equivalents and alternatives falling within the scope of the present invention as defined by the appended claim. As used throughout this description, the word "may" is used in a permissive sense (i.e. meaning having the potential to), rather than the mandatory sense (i.e. meaning must). Further, the words "a" or "an" mean "at least one" and the word "plurality" means "one or more" unless otherwise mentioned. Furthermore, the terminology and phraseology used herein is solely used for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited, and is not intended to exclude other additives, components, integers or steps. Likewise, the term "comprising" is considered synonymous with the terms "including" or "containing" for applicable legal purposes. Any discussion of documents, acts, materials, devices, articles and the like is included in the specification solely for the purpose of providing a context for the present invention. It is not suggested or represented that any or all of these matters form part of the prior art base or were common general knowledge in the field relevant to the present invention.

In this disclosure, whenever a composition or an element or a group of elements is preceded with the transitional phrase "comprising", it is understood that we also contemplate the same composition, element or group of elements with transitional phrases "consisting of", "consisting", "selected from the group of consisting of, "including", or "is" preceding the recitation of the composition, element or group of elements and vice versa.

The present invention is described hereinafter by various embodiments with reference to the accompanying drawing, wherein reference numerals used in the accompanying drawing correspond to the like elements throughout the description. This invention may, however, be embodied in many different forms and should not be construed as limited to the embodiment set forth herein. Rather, the embodiment is provided so that this disclosure will be thorough and complete and will fully convey the scope of the invention to those skilled in the art. In the following detailed description, numeric values and ranges are provided for various aspects of the implementations described. These values and ranges are to be treated as examples only, and are not intended to limit the scope of the claims. In addition, number of materials are identified as suitable for various facets of the implementations. These materials are to be treated as exemplary, and are not intended to limit the scope of the invention.

Referring to the drawings, the invention will now be described in more detail. In accordance with an embodiment of the present invention, the transportation box (100), as shown in FIGS. 1 (*a*) and 1(*b*), comprising a plurality of first phase change materials (16), a plurality of second phase change materials (20), a first box (18), a payload box (10), a second box (22) and an outer box (14).

In accordance with an embodiment of the present invention, the payload box (10), as shown in FIG. 1(*b*), is embedded with the plurality of second phase change materials (20) along a bottom panel (2), a top panel (12) and side panels (6) of the payload box (10). The payload box (10) is made up of a material selected from, but not limited to, a group consisting of corrugated materials, HDPE, Polypropylene, paper, cloth. Preferably, the payload box is made up of corrugated materials and lined with the plurality of second phase change materials (20), preferably, Form Stable Phase Change Material. The payload box (10) is further lined with a layer of an insulation material. Further, the payload box (10) is having a lid (12) which is also insulated with a layer (24) of the insulation material. The insulation material is selected from, but not limited to, a group consisting of polyethylene, extruded polystyrene, Expanded Polystyrene (EPS), vacuum insulated panels, XLPE, polyurethane, paperboards, honeycomb and other similar materials. Preferably, the insulation material is Expanded Polystyrene (EPS). Further, the insulation material is having a thickness in the range of, but not limited to, 5 mm to 100 mm.

In accordance with an embodiment of the present invention, the payload box (10) further comprises a plurality of lugs (7) protruding out of the side panels (6), as shown in FIG. 1(*b*). The plurality of lugs (7) have a length in the range of, but not limited to, 5 mm to 50 mm.

In accordance with an embodiment of the present invention, the payload box (10) is made up of a combination of insulation materials.

In accordance with an embodiment of the present invention, the first box (18) is adapted to enclose the payload box (10). The first box (18) is made up of the insulation material. The first box (18) is having a lid (18*a*) which is made up of the insulation material. The insulation material is selected from, but not limited to, a group consisting of polyethylene, extruded polystyrene, Expanded Polystyrene (EPS), vacuum insulated panels, XLPE, polyurethane, paperboards, honeycomb, a combination thereof and other similar materials. Preferably, the insulation material is Expanded Polystyrene (EPS). Further, the first box (18) is having a thickness in the range of, but not limited to, 10 mm to 100 mm.

In accordance with an embodiment of the present invention, the payload box (10) is placed inside the first box (18) at an equal distance in the range of, but not limited to, 5 mm to 50 mm from the bottom panel (2), the top panel (12) and the side panels (6) of the payload box (10) such that each of the plurality of lugs (7) snugly fits with sidewalls of the first box (18) and thus, holds the payload box (10) inside the first box (18). Preferably, the distance is 40 mm. Further, the length of the plurality of lugs (7) may be customized in accordance with the distance maintained from the bottom panel (2), the top panel (12) and the side panels (6) of the payload box (10).

In accordance with an embodiment of the present invention, the plurality of first phase change materials (16) and the plurality of second phase change materials (20) are filled in pouches. The pouches are made of material selected from, but not limited to, a group consisting of multilayer nylon and PET-Nylon. The pouches of the plurality of first phase change materials (16) are contained in a corrugated paper board box using an adhesive layer to ensure uniform freezing and melting throughout the pouch dimension. Also, the pouches of the plurality of first phase change materials (16) are contained in corrugated paper board box or other encapsulating materials. The placement of the pouches inside the corrugated paper board box avoids minimum contact between PCMs and users. The plurality of second phase change materials (20) are filled in multi celled pouches.

In accordance with an embodiment of the present invention, the pouches of the plurality of second phase change materials (20) are in direct contact with the payload box (10) on one or all sides, preferably all sides. In other words, the pouches of the plurality of second phase change materials (20) are in direct contact with the bottom panel (2), the top panel (12) and the side panels (6) of the payload box (10), as shown in FIG. 1(*b*). Further, the pouches of the plurality of second phase change materials (20) are fabricated in the payload box (10) so as to keep the users aloof from the installed PCM. The pouches of the plurality of first phase change materials (16) are placed above and below the payload box (10).

In accordance with an embodiment of the present invention, the plurality of first phase change materials (16) are selected from, but not limited to, a group consisting of organic chemicals, inorganic chemicals, eutectic chemicals and a combination thereof. Also, the plurality of first phase change materials (16) are selected from eutectic chemicals and their mixtures. Preferably, the eutectic chemicals are organic.

In accordance with an embodiment of the present invention, the plurality of second phase change materials (20) are selected from, but not limited to, organic chemicals, eutectic chemicals, polymers, Form Stable Phase Change Materials and a combination thereof. Preferably, the eutectic chemicals are organic. The plurality of second phase change materials (20) are adapted to be molded into, but not limited to, pellet form, cubical form, spherical form, sheet form and various other shapes and sizes. Preferably, the plurality of second phase change materials (20) are molded into thin sheets.

In accordance with an embodiment of the present invention, the plurality of second phase change materials (20) are Form Stable Phase Change Material. The Form Stable PCM allows flexibility for usage of PCM. The Form Stable PCM may be molded into any shape and size as per requirement.

In accordance with an embodiment of the present invention, the plurality of first phase change materials (16) and the plurality of second phase change materials (20) are selected from, but not limited to, a group consisting of HS23N, HS26N, HS18N, HS15N, HS7N, HS01, OM05, FS03, OM03, FS03, OM08, HS21, OM21, FS21, HS21, HS22, FS37.

In accordance with an embodiment of the present invention, the plurality of first phase change materials (16) and the plurality of second phase change materials (20) include thermal storage material selected from, but not limited to, a group consisting of paraffin, organic substance, inorganic substance, fatty acid, wax and eutectic mixture.

In accordance with an embodiment of the present invention, the plurality of first phase change materials (16) are frozen before use. The first phase change materials (16) do not need preconditioning and are arranged as soon as they have been taken out of a freezing chamber. The plurality of second phase change materials (20) do not need any freezing and may be kept at ambient above freezing temperature of the PCM, before assembling the transportation box (100).

In accordance with an embodiment of the present invention, the plurality of first phase change materials (16) such as, HS01 store maximum energy when kept for charging and act as a battery for the second or even third PCM when ready for transport. Further, the plurality of first phase change materials (16) provide minimum gradient between ambient and phase change temperature of the PCM.

In accordance with an embodiment of the present invention, the plurality of second phase change materials (20) get charged in the desired temperature range, such as −15 to −25° C., 2 to 8° C. and 15 to 25° C., by storing energy from the plurality of first phase change materials (16) which is frozen. Further, the plurality of second phase change materials (20) are leak proof and their thermal conductivity is low which helps in slow charging and discharging process.

In accordance with another embodiment of the present invention, the transportation box (200) further comprises a plurality of cassettes (28), as shown in FIG. 2(*a*). Each of the plurality of cassettes (28) contains two pouches of the plurality of first phase change materials (16) such that the stacked pouches do not interfere in freezing process. Each of the plurality of cassettes (28) is placed above and below the payload box (10). Each transportation box is packed with the plurality of cassettes (28), preferably four cassettes when frozen.

In accordance with an embodiment of the present invention, the payload box (26), as shown in FIG. 2(*b*), is not embedded with the plurality of second phase change materials (20) along the bottom panel (4), a top panel (27) and side panels (8) of the payload box (26).

In accordance with an embodiment of the present invention, the second box (22) is adapted to contain temperature sensitive products such as, but not limited to, vaccines, enzymes, body fluids and other perishable goods. The second box (22) is nestable within the payload box (10), as shown in FIG. 1(*b*). The second box (22) is made of, but not limited to, corrugated paper board.

In accordance with an embodiment of the present invention, the first box (18) containing the payload box (10) with the arrangement of the plurality of first phase change materials (16), the plurality of second phase change materials (20) and second box (22), is nestable within the outer box (14) and thus, making a single unit, that is, the transportation box (100).

In accordance with an embodiment of the present invention, the outer box (14) is made of a material selected from, but not limited to, a group consisting of polystyrene foam and thick corrugated paper board. Preferably, the outer box (14) is made of thick corrugated paper board. The outer box (14) is having a thickness in the range of, but not limited to, 1 mm to 10 mm. Preferably, the outer box (14) is having a thickness of 3 mm. The outer box (14) may have, but not limited to, a cuboidal shape or various other shapes.

In accordance with an embodiment of the present invention, the plurality of first phase change materials (16) and the plurality of second phase change materials (20) are arranged in a manner such that air in between the payload box (10) and the plurality of first phase change materials (16) controls heat flow into and within the first box (18).

In accordance with an embodiment of the present invention, the plurality of first phase change materials (16), the plurality of second phase change materials (20) and the air in between said payload box (10) and the plurality of first phase change materials (16) maintain a temperature in the range of −15 to −25° C., 2 to 8° C. or 15 to 25° C. inside the transportation box (100).

Figure 3:
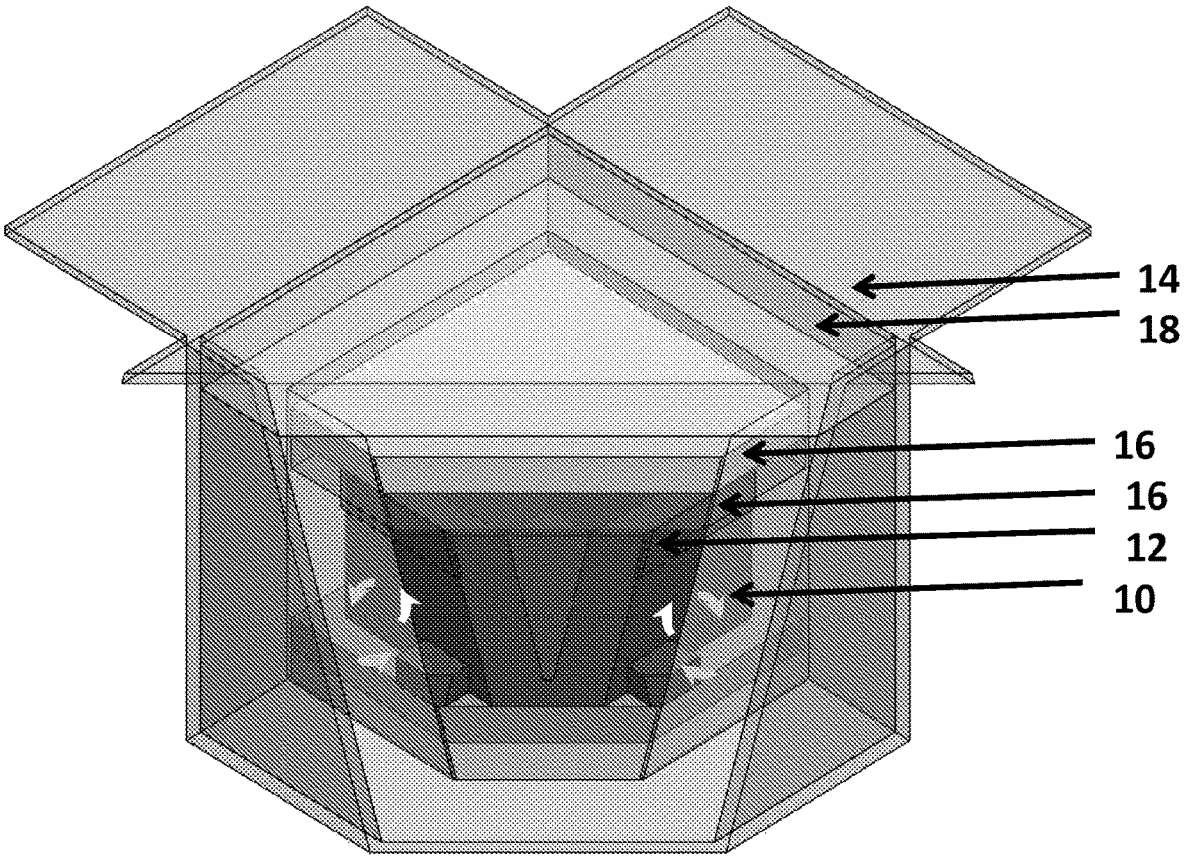
FIG. 3 illustrates a sectional view of the transportation box showing generation of convection currents inside the transportation box in accordance with an embodiment of the present invention.

FIG. 3 illustrates a sectional view of the transportation box (100) showing generation of convection currents inside the transportation box (100) in accordance with an embodiment of the present invention.

As shown in FIG. 3, when the plurality of first phase change materials (16) and the plurality of second phase change materials (20) are arranged inside the transportation box (100), an air gap is left to allow sufficient flow of stored energy from the plurality of first phase change materials (16) such as, HS01, to the plurality of second phase change materials (20). Air entrapped between slabs of the plurality of first phase change materials (16) helps to extract heat from the plurality of second phase change materials (20) and the plurality of second phase change materials (20) freeze due to energy stored in the plurality of first phase change materials (16). Further, the air gap allows the stored energy from the plurality of first phase change materials (16) to counter the heat ingress from the ambient. Moreover, if ambient temperature goes below the phase change temperature of the PCMs, the air gap allows reverse flow from the plurality of second phase change materials (20) to ambient.

The plurality of first phase change materials (16) such as, HS01, removed from the freezing chamber, when placed in the first box (18) is at ultra-low temperature, dependent on freezer temperature which varies from −20° C. to −40° C., cools the air in close proximity thereby making the air dense. Hot and light air rises and dense air starts settling down thereby creating convection currents inside the transportation box (100), as shown in FIG. 3. The air gap or air insulation controls the flow of cold to the payload box (10) which is further modulated by the PCM layer of the first phase change material (16) close to the payload box (10). The plurality of second phase change materials (20) are within a range of controlled temperature required such as, but not limited to, 2 to 8° C. or 15 to 25° C. Air convection currents slow down cold transfer from ultra-cold PCM, that is, plurality of first phase change materials (16).

Once convection currents set in, it helps in balancing heat gained by the air from ambient through the first box (18) and the outer box (14). The payload box (10), lined with the plurality of second phase change materials (20) such as, OM03 or FS03, when kept in ambient of low temperature, does not allow the temperature of medical products to get affected; because lining of FS03 releases its heat or absorbs cold energy from the plurality of first phase change materials (16) such as, HS01. Controlled space between the first box (18) and the payload box (10) (min 5 mm and max 40 mm, preferably 15-20 mm) is kept for air flow that controls heat exchange from the ambient.

Quantity of FS03 used in the payload box (10) is such that latent heat of FS03 gets balanced with specific heat and latent heat of HS01 during the complete process. As soon as HS01 gets molten due to heat ingress from ambient, frozen FS03 starts maintaining the temperature of temperature sensitive products in the desired range, such as −15 to −25° C., 2 to 8° C. and 15 to 25° C.

During this whole process, FS03 because of its freezing and then melting cycle helps to maintain desired range, 2 to 8° C., for more than 100 hours. Further experiments performed using the same transportation box (100) but with variable volume of payload box (10) confirmed that the air gap left for energy exchange plays a vital role in regulating temperature.

Hereinafter, non-limiting examples of the present invention will be provided for more detailed explanation which are not meant to limit the scope of the invention in any manner.

EXAMPLES

Example 1

Figure 4:
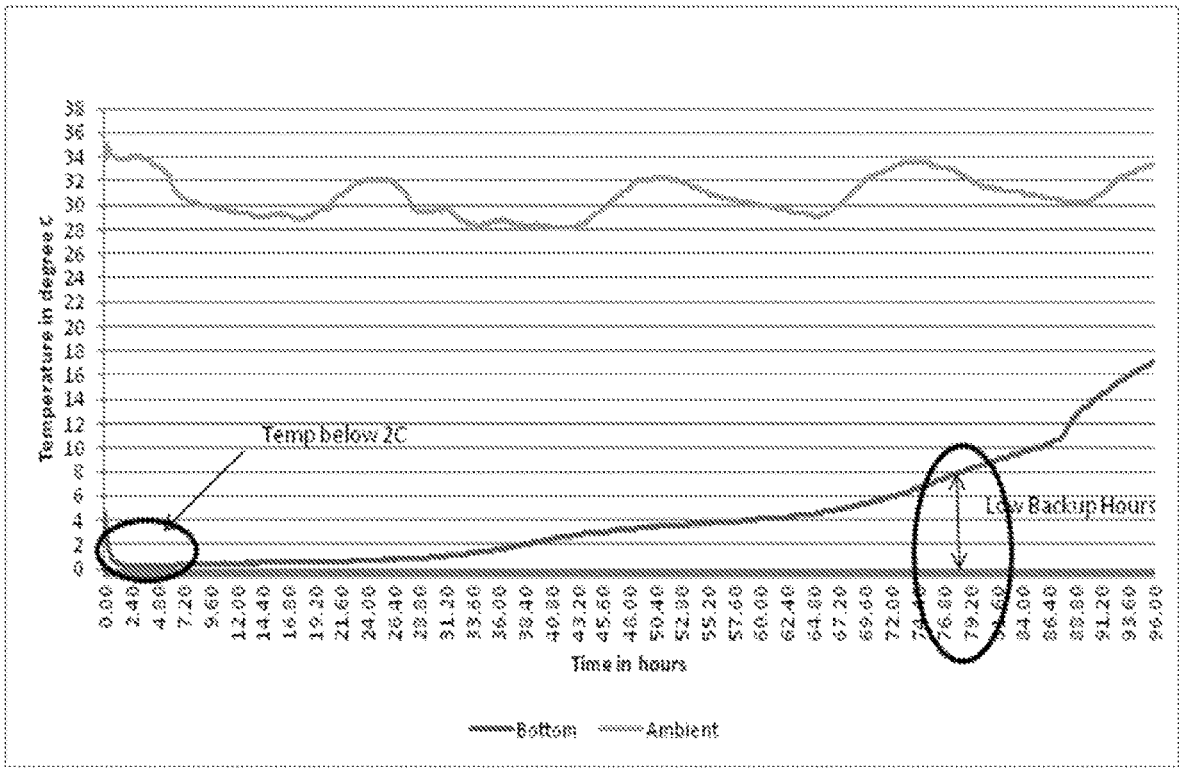
FIG. 4 is a graph showing back up hours of the transportation box at a desired temperature of 2 to 8° C. in accordance with an exemplary embodiment of the present invention.

A transportation box having first box made of expanded polystyrene is arranged in such a way so as to contain PCM of zero degree and 3 degree. Both PCM were frozen and conditioned to ensure that the temperature of payload box does not fall below the desired range of 2-8° C. Setup was placed in an ambient of 30° C. Minimum temperature observed was 0.3° C. and reached 8° C. in 79 hours, as shown in FIG. 4.

Example 2

Figure 1B:
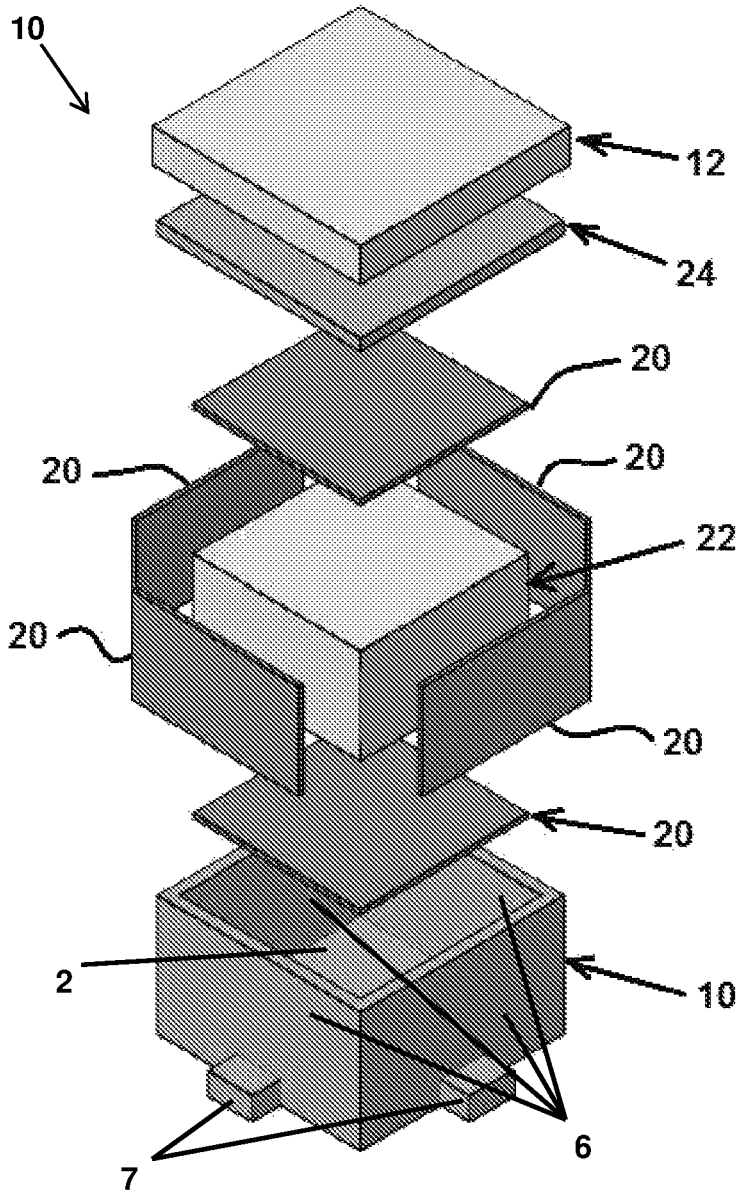
Figure 5:
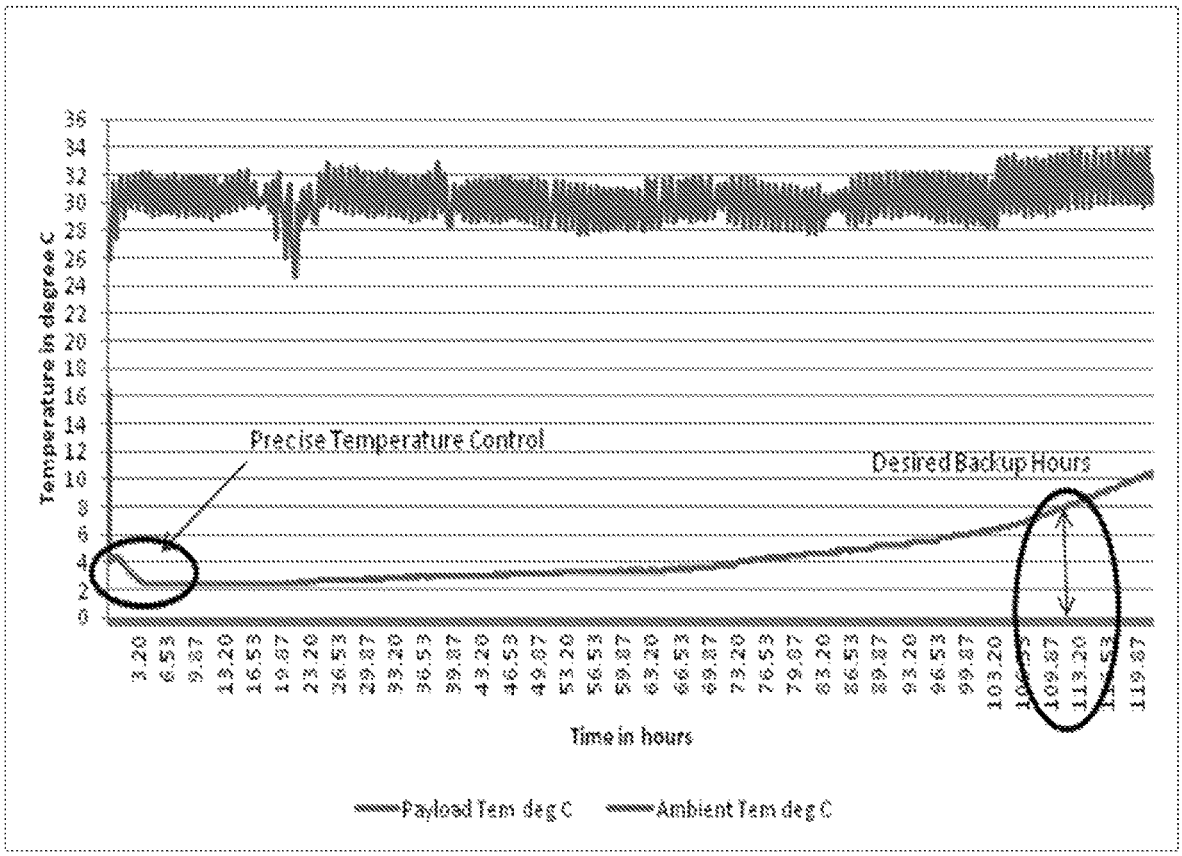
FIG. 5 is a graph showing back up hours of the transportation box at a desired temperature of 2 to 8° C. in accordance with another exemplary embodiment of the present invention.

A transportation box having first box made of expanded polystyrene is arranged in such a way so as to contain PCM of zero degree and 3 degree PCM. Zero degree PCM was frozen and 3 degree PCM was placed at room temperature. Frozen zero degree PCM was arranged in a cassette so as to ensure it remains intact once it melts during the process. Arrangement of the transportation box is, as shown in FIGS. 1*a* and 1*b*. The second 3 degree PCM, without charging, was arranged in the payload box which carries the sensitive goods. Setup was placed in an ambient of 30° C. for 96 hours. Minimum temperature observed during the experiment was 2.5° C. and maximum temperature at the end of 96 hours was 5.6° C., as shown in FIG. 5. This example portrays the contrast of technology used in comparison with example 1.

Example 3

Figure 6:
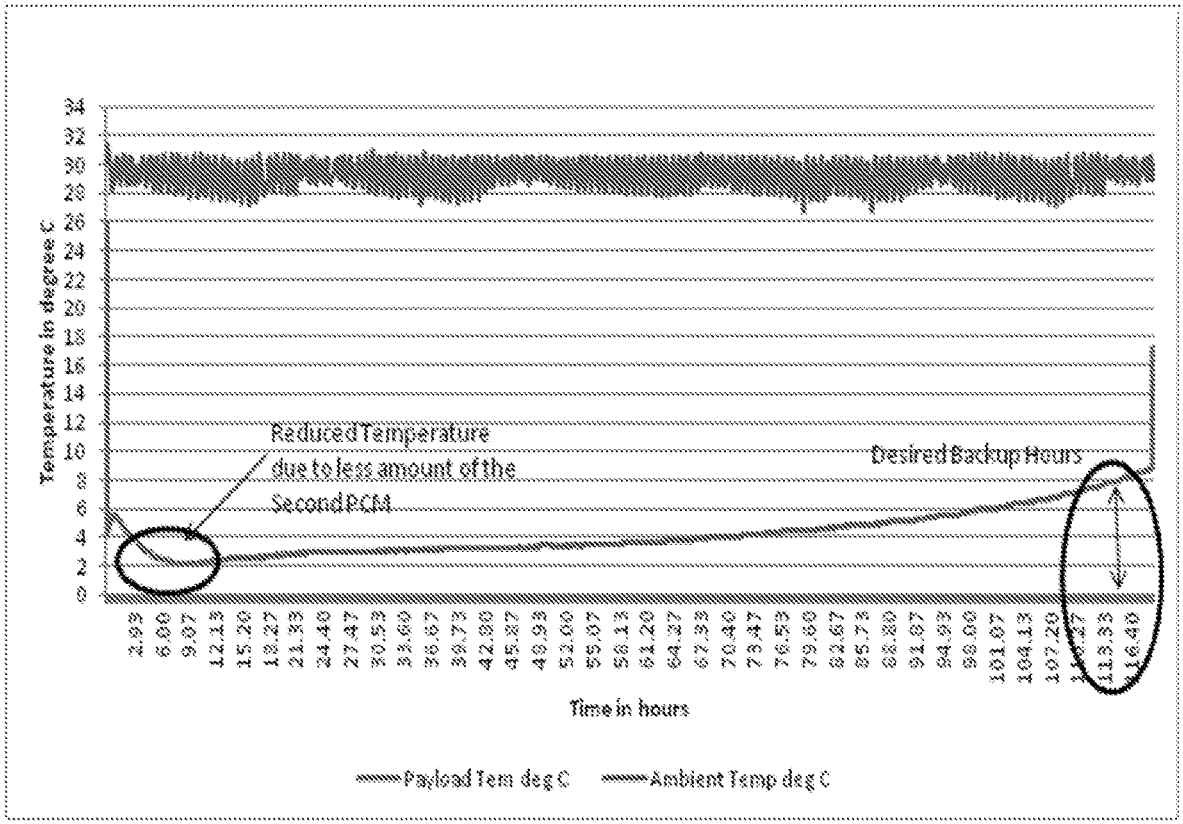
FIG. 6 is a graph showing back up hours of the transportation box at a desired temperature of 2 to 8° C. in accordance with yet another exemplary embodiment of the present invention.

In yet another example, a transportation box similar to the one described in example 2 was used but amount of the second PCM is reduced to optimize the quantity used. Setup was placed in an ambient of 30° C. for 96 hours. Minimum temperature observed during the experiment was 2.2° C., which is within the limit of the desired minimum temperature. Maximum temperature at the end of 96 hours was 5.6° C., as shown in FIG. 6. Experimental values confirmed that amount of PCM incorporated in the transportation box mentioned in example 2 is just enough to store cold energy from frozen PCM and helps in maintaining temperature once the frozen PCM is completely exhausted.

Example 4

Figure 7:
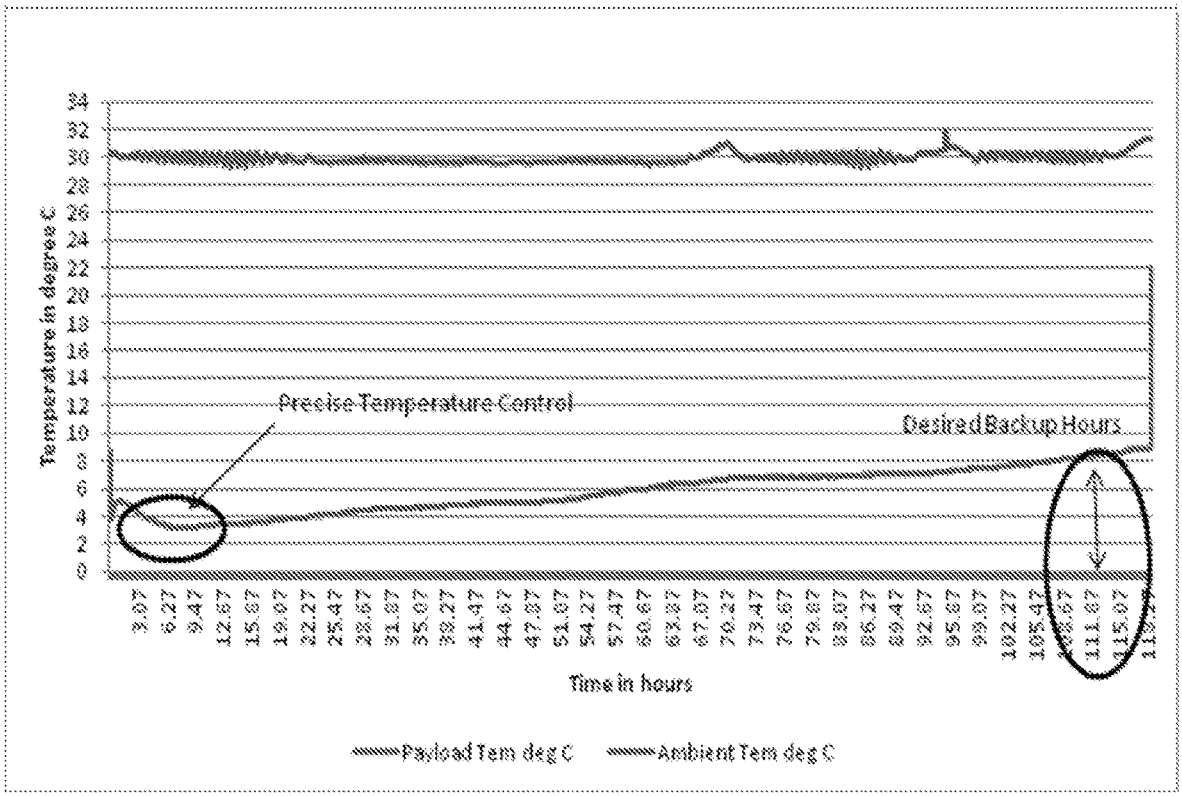
FIG. 7 is a graph showing back up hours of the transportation box at a desired temperature of 2 to 8° C. in accordance with yet another exemplary embodiment of the present invention.

In yet another example, a transportation box with similar arrangement as shown in FIGS. 1*a* and 1*b* was used. Size of the payload box was increased but air volume inside the transportation box was proportionally increased. Setup was placed in an ambient of 30° C. for 96 hours. Minimum temperature observed during the experiment was 3.2° C., which was within the limit of the desired minimum temperature. Maximum temperature at the end of 96 hours was 7.2° C., as shown in FIG. 7. Experimental results can be extrapolated to have smaller or even large sized transportation boxes. By increasing or decreasing the air gap proportionally transportation box can be modified to carry any volume of perishable goods.

Example 5

Figure 8:
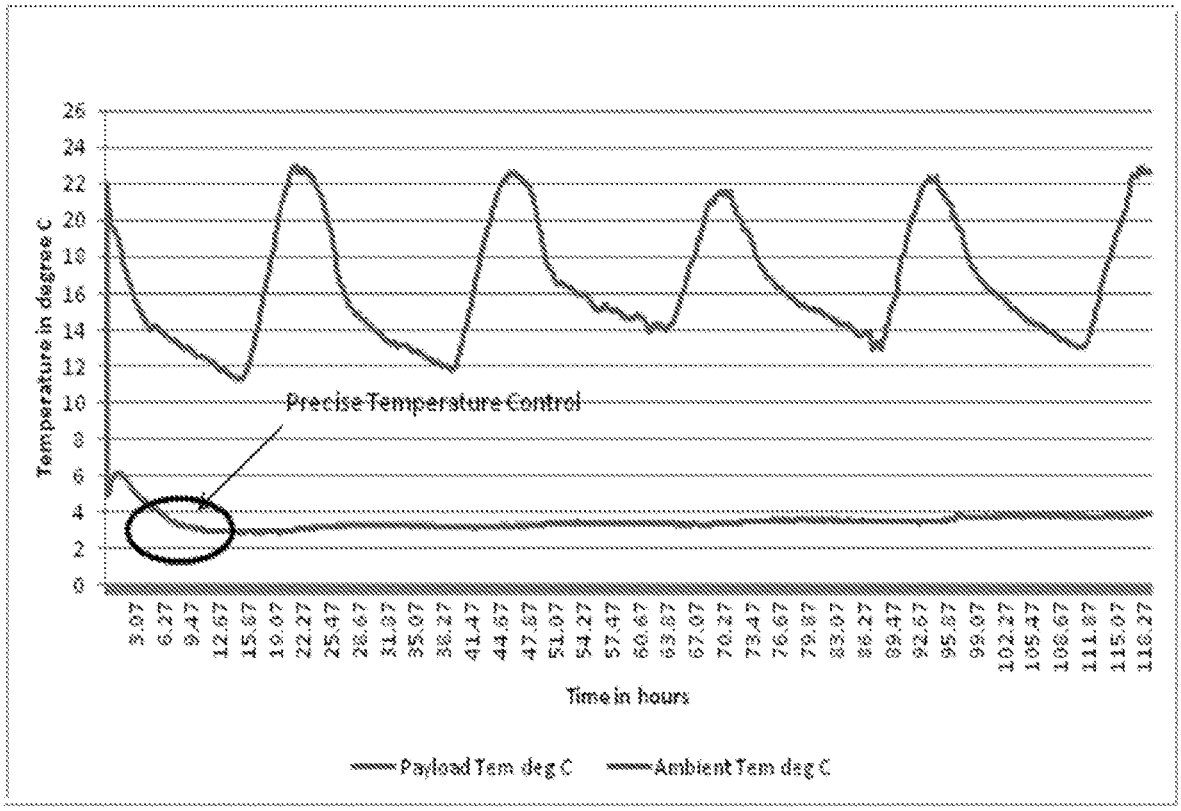
FIG. 8 is a graph showing back up hours of the transportation box at a desired temperature of 2 to 8° C. with varied ambient temperature in accordance with yet another exemplary embodiment of the present invention.

In yet another example, a transportation box similar to that described in example 2 was used but setup was placed in an ambient of variable temperature where temperature varied from 10-25° C. during day and night for 96 hours. Minimum temperature observed during the experiment was 1.9° C., which was an undesirable temperature for transportation of certain sensitive goods. Experimental values confirmed that the amount of PCM incorporated in the transportation box mentioned in example 2 was more than required for safe delivery of products. To rectify this situation a new box was designed where first PCM quantity was reduced and quantity of the second PCM was kept intact. Reduction in first PCM reduced overall latent heat of the transportation box which in turn controls the cold energy in the payload box. Result shown in FIG. 8 indicates that the quantity of first PCM plays a very important role in maintaining temperature inside the transportation box in case of ambient temperature fluctuations. Minimum temp in this design was observed to be 2.9° C.

Example 6

Figure 9:
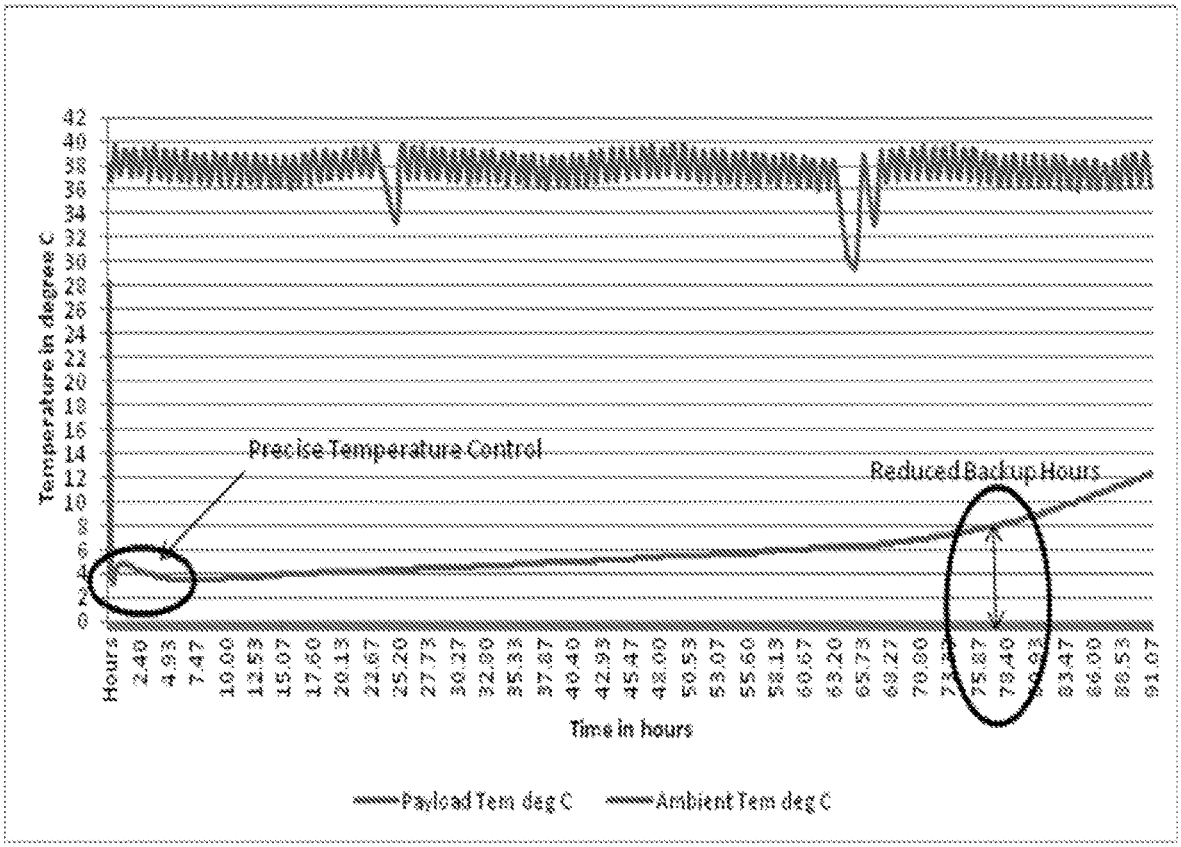
FIG. 9 is a graph showing back up hours of the transportation box at a desired temperature of 2 to 8° C. in accordance with yet another exemplary embodiment of the present invention.

In yet another example, a transportation box similar to the one described in example 2 was used but setup was placed in an ambient of variable temperature where temperature was higher than 30° C. during day and cooler during night for 96 hours. Experimental results showed minimum temperature during the experiment was 3.4° C. and back up hours reduced from 96 hours to 78 hours. Experimental values confirmed that air insulation used in the transportation box counters the heat ingress from ambient by utilizing the stored energy from frozen PCM. PCM relative to example 2 gets more exhausted in balancing the heat from ambient and hence second PCM installed in payload absorbs less energy thereby leading to lesser number of back up hours, as shown in FIG. 9.

Example 7

Figure 10:
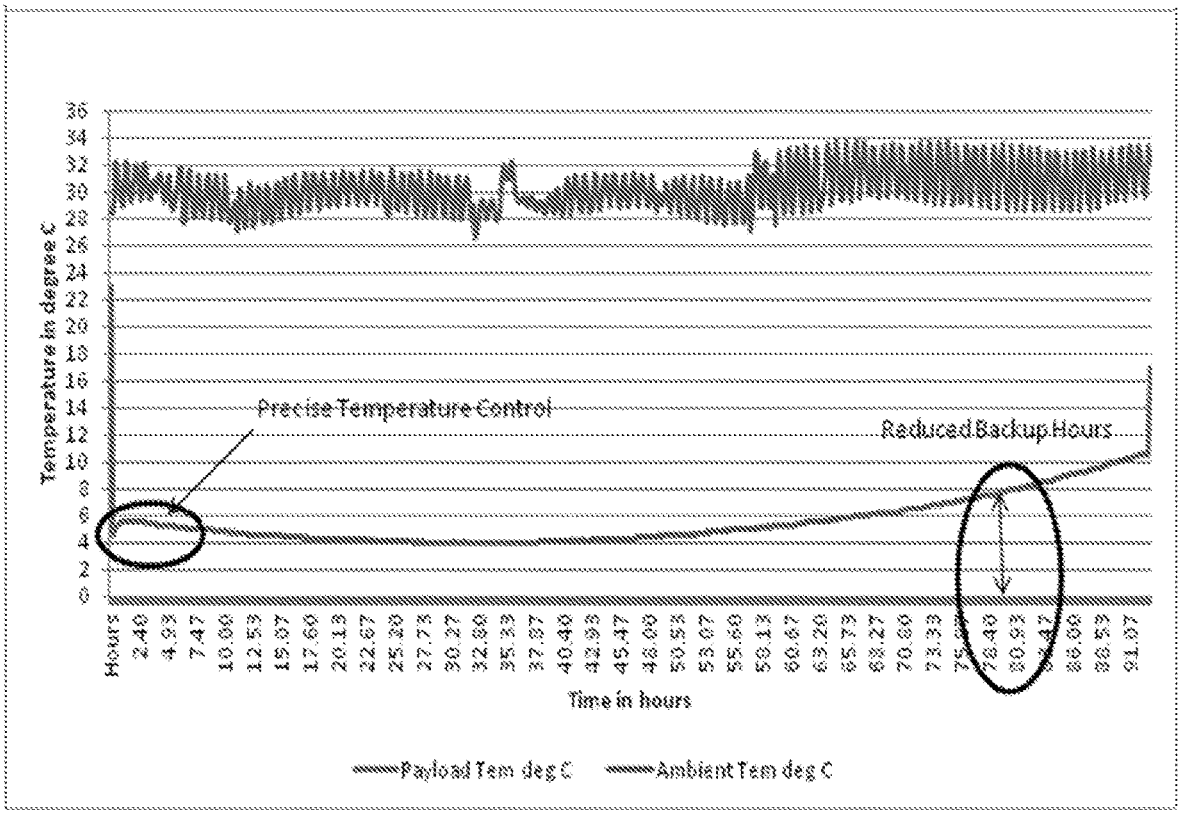
FIG. 10 is a graph showing back up hours of the transportation box at a desired temperature of 2 to 8° C. with an ambient temperature of 30° C. in accordance with yet another exemplary embodiment of the present invention.

In yet another example, volume of air insulation was varied between 20 mm to 60 mm in the transportation box similar to shown in figure. Setup was placed in an ambient of 30° C. for 96 hours. For air gap thickness of 20 mm, minimum temperature observed during the experiment was 4° C., and maximum temperature at the end of 96 hours was 8.1° C., as shown in FIG. 10. Experimental results explained that the volume of air if decreased, leads to early exhaustion of the PCM quantity and higher air gap leads to undesirable dip in temperature. Hence air gap is optimized at 40 mm.

Example 8

Figure 2A:
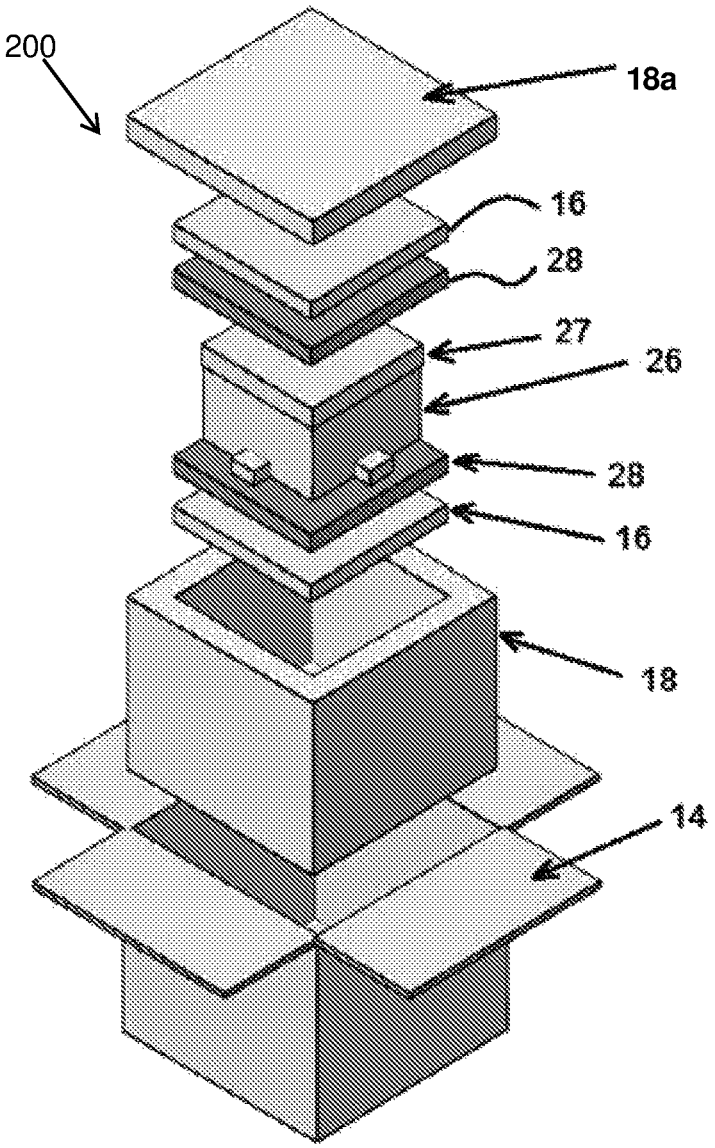
Figure 2B:
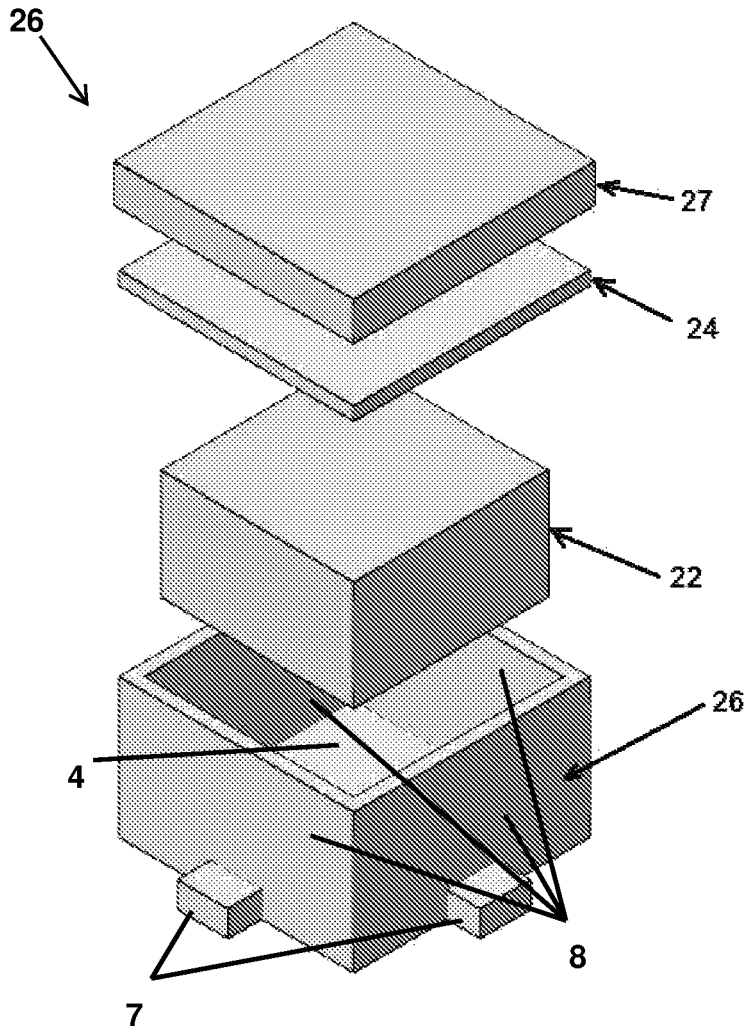
Figure 11:
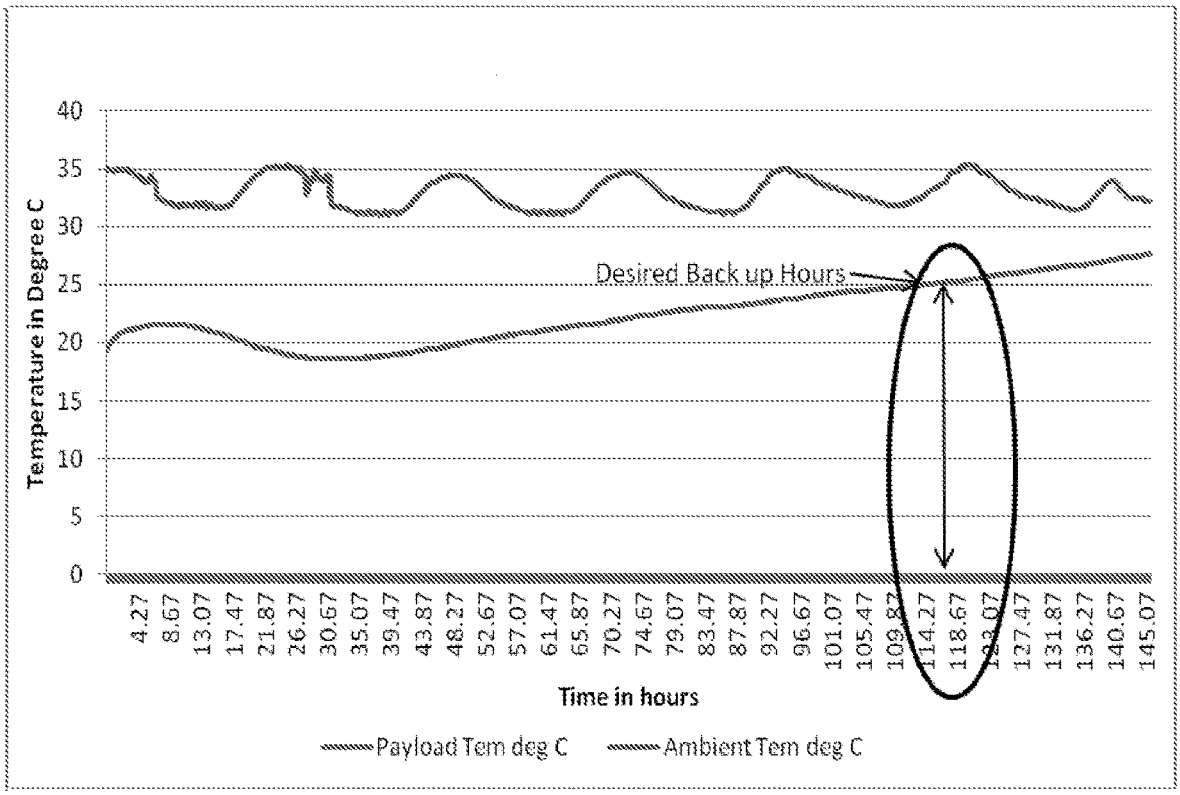
FIG. 11 is a graph showing back up hours of the transportation box at a desired temperature of 0 to 25° C. in accordance with yet another exemplary embodiment of the present invention.

A transportation box made of expanded polystyrene is arranged in such a way so as to contain PCM of zero degree and 22 degree. The first PCM was frozen and the second was left at room temperature. The first frozen PCM was arranged in a cassette so as to ensure it remains intact once it melts during the process. Arrangement of the transportation box is as shown in FIGS. 2*a* and 2*b*. Second PCM was arranged in the payload box which carries the sensitive goods, as shown in FIG. 1*b*. Setup was placed in an ambient of 30° C. for 96 hours. Minimum temperature observed during the experiment was 18.6° C. and maximum temperature at the end of 96 hours was 23.8° C., as shown in FIG. 11.

The above-mentioned transportation box overcomes the problems and shortcomings of the existing methods of transportation using PCMs and provides a number of advantages over them. The transportation box regulates the temperature by cascading of two or more PCMs and thus provides extra number of backup hours for transportation of temperature sensitive goods such as blood, vaccines and other sensitive products. The air gap introduced in the transportation box acts as a carrier fluid; since one PCM is charged in the freezer, the air gap carries excess of stored energy in the form of specific heat. If this energy comes in direct contact with the payload or second PCM, temperature of the sensitive products goes well below the desired range. Air gap allows this excess energy to get transferred to the second PCM. Air gap allows this energy transfer to take place at a very slow rate and ensures temperature control within the desired range. The air gap serves as an additional layer of insulation for the payload box as against other insulation material and also, acts as a barrier between ambient and the second PCM. Once first PCM gets discharged and second PCM start playing its role, air acts a barrier and does not allow second PCM to get discharged at fast rate and hence increases back up hours.

In addition, usage of the Form Stable Phase Change Material (PCM) in the transportation box ensures leak proof delivery of package or temperature sensitive products even if there is damage to the transportation box during transportation. It also ensures that no bulging of pouches takes place when PCM is loaded in the payload box. Also, the transportation box is user friendly and a fool proof method for logistics of perishable goods.

The exemplary implementation described above is illustrated with specific shapes, dimensions, and other characteristics, but the scope of the invention includes various other shapes, dimensions, and characteristics. Also, the transportation box as described above could be designed and fabricated in various other ways and could include various other materials and various other PCMs, insulation materials etc.

Various modifications to these embodiments are apparent to those skilled in the art from the description and the accompanying drawings. The principles associated with the various embodiments described herein may be applied to other embodiments. Therefore, the description is not intended to be limited to the embodiments shown along with the accompanying drawings but is to be providing broadest scope of consistent with the principles and the novel and inventive features disclosed or suggested herein. Accordingly, the invention is anticipated to hold on to all other such alternatives, modifications, and variations that fall within the scope of the present invention and appended claims.

We claim:

1. A transportation box, comprising:

a plurality of first phase change materials (16);

a plurality of second phase change materials (20);

a layer (24) of insulation material;

a first box (18) adapted to enclose a payload box (10); and a second box (22) adapted to contain temperature sensitive products;

wherein said second box (22) is nestable within said payload box (10);

wherein said first box (18) is nestable within an outer box (14);

wherein said plurality of second phase change materials (20) are embedded and fabricated in a bottom panel (2), a top panel (12) and side panels (6) of said payload box (10), wherein said second phase change materials (20) are disposed along an inner surface of each of the bottom panel (2), the top panel (12) and the side panels (6);

wherein a first pair of said plurality of first phase change materials (16) is placed above said payload box (10) and is stacked vertically between the top panel (12) and the first box (18) and a second pair of said plurality of phase change materials (16) is placed below said payload box (10) and is stacked vertically between the bottom panel (2) and the first box (18); and wherein the layer (24) of insulation material is sandwiched between the top panel (12) and the second phase change material (20).

2. The transportation box (100) as claimed in claim 1, wherein said payload box (10) and said first box (18) are made of an insulation material selected from a group consisting of polyethylene, extruded polystyrene, Expanded Polystyrene (EPS), vacuum insulated panels, XLPE, polyurethane, paperboards, honeycomb and a combination thereof.

3. The transportation box (100) as claimed in claim 2, wherein said insulation material of said payload box (10) is having a thickness in a range of 5 mm to 100 mm.

4. The transportation box (100) as claimed in claim 2, wherein said first box (18) is having a thickness in a range of 10 mm to 100 mm.

5. The transportation box (100) as claimed in claim 1, wherein said payload box (10) is made of a material selected from a group consisting of corrugated materials, HDPE, Polypropylene, paper and cloth.

6. The transportation box (100) as claimed in claim 1, wherein said second box (22) is made of corrugated paperboard.

7. The transportation box (100) as claimed in claim 1, wherein said outer box (14) is made of material selected from a group consisting of polystyrene foam and thick corrugated paperboard.

8. The transportation box (100) as claimed in claim 7, wherein said outer box (14) is having a thickness in a range of 1 mm to 10 mm.

9. The transportation box (100) as claimed in claim 1, wherein said plurality of first phase change materials (16) are selected from a group consisting of organic chemicals, inorganic chemicals, eutectic chemicals and a combination thereof.

10. The transportation box (100) as claimed in claim 1, wherein said plurality of second phase change materials (20) are selected from organic chemicals, eutectic chemicals, polymers, Form Stable Phase Change Materials and a combination thereof.

11. The transportation box (100) as claimed in claim 1, wherein said plurality of first phase change materials (16) and said plurality of second phase change materials (20) are selected from a group consisting of HS23N, HS26N, HS18N, HS15N, HS7N, HS01, 0M05, F503, 0M03, F503, 0M08, HS21, 0M21, FS21, HS21, HS22, FS37.

12. The transportation box (100) as claimed in claim 1, wherein said plurality of second phase change materials (20) are adapted to be molded into pellet form, cubical form, spherical form and sheet form.

13. The transportation box (100) as claimed in claim 1, wherein said plurality of first phase change materials (16) are frozen before use.

14. The transportation box (100) as claimed in claim 1, wherein said plurality of second phase change materials (20) freeze due to energy stored in said plurality of first phase change materials (16).

15. The transportation box (100) as claimed in claim 1, wherein said plurality of first phase change materials (16) and said plurality of second phase change materials (20) are arranged inside said transportation box (100) to allow sufficient flow of stored energy from said plurality of first phase change materials (16) to said plurality of second phase change materials (20);

wherein air entrapped between said plurality of first phase change materials (16) helps to extract heat from said plurality of second phase change materials (20).

16. The transportation box (100) as claimed in claim 1, wherein said plurality of first phase change materials (16), said plurality of second phase change materials (20) and an air disposed in between said payload box (10), said first box (18), and said plurality of first phase change materials (16) maintain a temperature in a range of −15 to −25° C. inside said transportation box (100).

17. The transportation box (100) as claimed in claim 1, wherein said plurality of first phase change materials (16) are placed in said first box (18) at ultra-low temperature to make an air dense;

wherein hot and light air rises and dense air settles down creating convection current inside said transportation box (100).

18. The transportation box (100) as claimed in claim 1, wherein said plurality of first phase change materials (16), said plurality of second phase change materials (20) and an air disposed in between said payload box (10), said first box (18), and said plurality of first phase change materials (16) maintain a temperature in a range of 2 to 8° C. inside said transportation box (100).

19. The transportation box (100) as claimed in claim 1, wherein said plurality of first phase change materials (16), said plurality of second phase change materials (20) and an air disposed in between said payload box (10), said first box (18), and said plurality of first phase change materials (16) maintain a temperature in a range of 15 to 25° C. inside said transportation box (100).

20. The transportation box (100) as claimed in claim 1, wherein said payload box (10) comprises a plurality of lugs (7) to hold said payload box (10) inside said first box (18).

21. The transportation box (100) as claimed in claim 20, wherein said payload box (10) is placed inside said first box (18) at an equal distance in a range of 5 mm to 50 mm from said bottom panel (2), said top panel (12) and side panels (6) of said payload box (10) such that each of said plurality of lugs (7) snugly fits with sidewalls of said first box (18).

* * * * *